US009329607B2

(12) United States Patent
Kevelos et al.

(10) Patent No.: US 9,329,607 B2
(45) Date of Patent: May 3, 2016

(54) ELECTRICAL LOAD CONTROLLER HAVING A FRAME WITH AN INTEGRALLY FORMED BACKLIGHTABLE INDICATOR REGION

(71) Applicant: Leviton Manufacturing Co., Inc., Melville, NY (US)

(72) Inventors: Adam Kevelos, Plainview, NY (US); Renjith Mathew, New Hyde Park, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 92 days.

(21) Appl. No.: 14/455,610

(22) Filed: Aug. 8, 2014

(65) Prior Publication Data

US 2016/0041569 A1 Feb. 11, 2016

(51) Int. Cl.
*G05F 1/455* (2006.01)
*G08B 5/36* (2006.01)

(52) U.S. Cl.
CPC . *G05F 1/455* (2013.01); *G08B 5/36* (2013.01)

(58) Field of Classification Search
CPC ..... H05B 39/083; H05B 39/08; H01H 13/83; H01H 9/161; H01H 13/023; H01H 23/025; H01H 2219/062
USPC ..... 323/318, 320, 905; 200/310, 313, 314, 200/315, 317
See application file for complete search history.

(56) References Cited

U.S. PATENT DOCUMENTS 3,986,022 A * 10/1976 Hyatt ..... B60R 16/0373 250/205
5,012,495 A 4/1991 Munroe et al.
5,262,678 A 11/1993 Flowers et al.
5,637,930 A * 6/1997 Rowen ..... H01H 3/0213 307/112
5,945,647 A 8/1999 Hoskins
6,005,308 A 12/1999 Bryde et al.
7,170,018 B2 1/2007 Ilkhanov
7,345,998 B2 3/2008 Cregg et al.
7,663,325 B2 2/2010 McDonough et al.
7,670,039 B2 3/2010 Altonen et al.
7,985,937 B2 7/2011 Wu et al.
8,003,904 B2 8/2011 Wu
8,138,435 B2 3/2012 Patel et al.
8,173,920 B2 5/2012 Altonen et al.

(Continued)

OTHER PUBLICATIONS

Adam Kevelos, pending U.S. Appl. No. 14/455,616, filed Aug. 8, 2014, "Dimmer Switch Having Dimmer Actuator Operable for Actuating an Air-Gap Switch".

(Continued)

*Primary Examiner* — Adolf Berhane
(74) *Attorney, Agent, or Firm* — Heslin Rothenberg Farley & Mesiti P.C.

(57) ABSTRACT

An electrical load controller includes an electrical switching device and an actuator assembly having at least one user actuator for use in turning power on and off to the load and for use in adjustably controlling the level of power to the load. A frame attached to the actuator includes an integrally formed backlightable indicator region having an outer continuous solid surface. Light from an illumination assembly related to the level of power to the load is directable onto a portion of an inner surface of the backlightable indicator region, transmittable through the backlightable region from the inner surface to the outer surface, emittable from a portion of the outer surface, and observable by the user.

31 Claims, 15 Drawing Sheets

(56) References Cited

U.S. PATENT DOCUMENTS

| | | | | |
|---|---|---|---|---|
| 8,459,812 | B2 | 6/2013 | Wu et al. | |
| 8,536,473 | B2 | 9/2013 | Goyal et al. | |
| 8,558,470 | B2 * | 10/2013 | Shteynberg | H05B 33/0815 315/224 |
| 8,669,720 | B2 | 3/2014 | Goyal et al. | |
| 8,717,718 | B2 | 5/2014 | Kamor et al. | |
| 2005/0099824 | A1 * | 5/2005 | Dowling | A61B 1/0653 362/572 |
| 2007/0193863 | A1 | 8/2007 | Wu | |
| 2008/0151458 | A1 * | 6/2008 | Beland | G05D 23/1902 361/114 |
| 2009/0256483 | A1 * | 10/2009 | Gehman | H05B 37/0272 315/129 |
| 2010/0101924 | A1 | 4/2010 | Wu et al. | |
| 2012/0257316 | A1 | 10/2012 | Kamor et al. | |
| 2013/0162167 | A1 | 6/2013 | Gallo | |
| 2013/0162168 | A1 | 6/2013 | Ostrovsky | |
| 2014/0253483 | A1 * | 9/2014 | Kupersztoch | H05B 37/02 345/173 |

OTHER PUBLICATIONS

Product Brochure for The Mural Collection, Leviton Manufacturing Co., Inc., Melville, New York, 12 pages, 2000.

Product Brochure for The Mural Collection II, Leviton Manufacturing Co., Inc., Melville, New York, 7 pages, 2002.

* cited by examiner

ELECTRICAL LOAD CONTROLLER HAVING A FRAME WITH AN INTEGRALLY FORMED BACKLIGHTABLE INDICATOR REGION

FIELD OF THE DISCLOSURE

The present disclosure relates generally to electrical load controllers, and more specifically to electrical load controllers having a frame with an integrally formed backlightable indicator region.

BACKGROUND

Electrical wiring systems often include one or more electrical wiring devices, such as dimmer switches, that control power to one or more loads. A dimmer switch has a main actuator for turning power ON/OFF to the load. An example of such an actuator includes a paddle or push pad capable of being depressed within a frame located on the front face of the dimmer. The dimmer switch also includes an intensity level actuator for controlling the magnitude of power to the load.

Conventional dimmer switches include an intensity level indicator. The intensity level indication is typically a linear array representing a linear scale (between off and full intensity of the associated load) such that one or more of the status indicators are illuminated to indicate the intensity of the lighting load. In some conventional dimmer switches, the dimmer switch typically includes a frame having one or more apertures extending through the frame for receiving a light guide assembly or linear array of light emitting diodes in which light emitted therefrom indicates the level of power being delivered to a load.

There is a need for further electrical load controllers, and more specifically to electrical load controllers having a frame with an integrally formed backlightable indicator region.

SUMMARY

In a first aspect, the present disclosure provides an electrical load controller for use in controlling electrical power to a load from an electrical power source. The electrical load controller includes an electrical switching device for turning electrical power on and off to the load and for controlling a level of power to the load, and an actuator assembly. The actuator assembly includes at least one user actuator actuatable by a user for use in turning on and off electrical power to the load and for use in adjustably controlling the level of power to the load, a frame operably attached to the at least one actuator, and an illumination assembly for providing illumination related to the level of power to the load. The frame includes an integrally formed backlightable indicator region having an outer continuous solid surface. Light from the illumination assembly related to the level of power to the load is directable onto a portion of an inner surface of the backlightable indicator region, transmittable through the backlightable indicator region from the inner surface to the outer surface, emittable from a portion of the outer surface, and observable by the user.

In a second aspect, the present disclosure provides an electrical load controller for use in controlling electrical power to a load from an electrical power source. The electrical load controller includes an electrical switching device for turning electrical power on and off to the load and for controlling a level of power to the load, an actuator assembly, and an illumination assembly for providing illumination related to the level of power to the load. The illumination assembly includes a light source and a plurality of light guides. The actuator assembly includes a main actuator actuatable by a user for use in turning on and off electrical power to the load, a peripherally-extending frame disposed around the main actuator, an intensity level actuator extendable though an opening in the peripherally-extending frame actuatable by a user for use in adjustably controlling the level of power to the load. The peripherally-extending frame has an integrally formed indicator region having an outer continuous solid surface. Light from the illumination assembly related to the level of power to the load is directable onto a portion of an inner surface of the backlightable indicator region, transmittable through the backlightable indicator region from the inner surface to the outer surface, emittable from a portion of the outer surface, and observable by the user.

In a third aspect, the present disclosure provides an actuator assembly attachable to an electrical switching device of an electrical load controller. The actuator assembly includes a main actuator actuatable by a user for in turning on and off electrical power to the load, a peripherally-extending frame disposed around the main actuator, and an intensity level actuator extendable though an opening in the peripherally-extending frame. The intensity level actuator is actuatable by a user for in adjustably controlling the level of power to the load. The peripherally-extending frame includes an integrally formed indicator region having an outer continuous solid surface. Light from an illumination assembly in the electrical load controller related to the level of power to the load is directable onto a portion of an inner surface of the backlightable indicator region, transmittable through the backlightable indicator region from the inner surface to the outer surface, emittable from a portion of the outer surface, and observable by the user.

BRIEF DESCRIPTION OF THE DRAWINGS

One or more aspects of the present invention are particularly pointed out and distinctly claimed at the conclusion of the specification. The foregoing and other objects, features, and advantages of the invention are apparent from the following detailed description taken in conjunction with the accompanying drawings in which:

DETAILED DESCRIPTION

Figure 1:
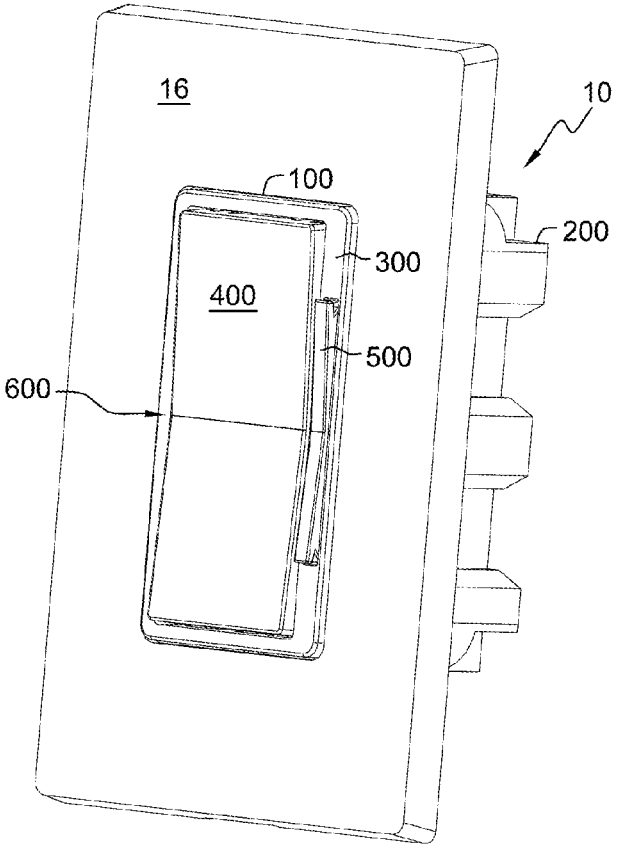
FIG. 1 is a perspective view of one embodiment of an electrical load controller such as a dimmer switch illustrating power to a load being turned off so that a frame with an integrally formed backlightable indicator region is not illuminated in accordance with aspects of the present disclosure.

FIG. 1 illustrates an exemplary embodiment of an electrical load controller in accordance with aspects of the present disclosure. In this exemplary embodiment, an electrical load controller may be a dimmer switch 10. While the present description describes an electrical load controller in the form of a dimmer switch, it will be appreciated that the techniques of the present disclosure is not limited to dimmer switches but may be applied to other types of electrical load controllers or wiring devices; e.g., a fan speed controller, a countdown timer, a shade controller, a temperature/humidity controller, an outlet/receptacle, etc. In this exemplary embodiment, dimmer switch 10 may generally include a switch plate assembly or actuator assembly 100 coupled to a dimmer module 200. Actuator assembly 100 may be a self-contained unit which includes a bezel or frame 300, a main actuator 400 (e.g., rocker or paddle), and an intensity level actuator 500 (e.g., a rocker or paddle for adjusting a dimming level, a timer setting, a fan speed, etc.). Generally, a user may operate dimmer switch 10 by pressing main actuator 400 to operably switch power ON or OFF to a load, such as but not limited to a light fixture or to a fan. In addition, a user may operate intensity level actuator 500 to adjust the level of power to the load. While the main actuator and intensity level actuator are illustrated as extending outwardly from the frame, it will be appreciated that the main actuator and intensity level actuator may be recessed relative to the frame. In addition, it will be appreciated that the frame, the main actuator, and the intensity level actuator may have any suitable configuration or arrangement.

Frame 300 may also include an integrally formed backlightable indicator region 600 to indicate to a user the level of power being supplied to a load. For example, in one embodiment, backlightable indicator region 600 may indicate, via a linear scale, the ratio of the actual level of power being supplied to the load as compared with the full intensity of power that could be supplied to the load. Alternatively, indicator region 600 can indicate the actual level of power being supplied to the load in a nonlinear fashion such as but not limited to a logarithmic scale. Additionally, indicator region 600 can indicate the actual level of power being supplied to the load in inverse proportion. As will be apparent to those skilled in the art, backlightable indicator region 600 may give a user any suitable indication such as but not limited to a power lever, a status level, a temperature level, a humidity level, a sensed level, a remote monitoring level, etc.

Figure 2:
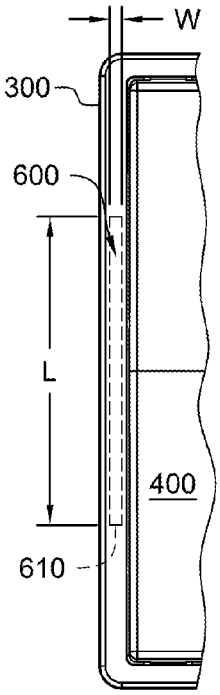
FIG. 2 is an enlarged front view of a portion of the frame with the integrally formed backlightable indicator region of FIG. 1 depicted in broken line.

As shown in FIG. 2 and described in greater detail below, integrally formed backlightable indicator region 600 may include an outer continuous solid surface 610 (illustrated in dashed lines) of frame 300, where the outer continuous solid surface in this exemplary embodiment may have a length L and a width W. It will be appreciated that in other embodiments, the power level indicator region may have other configurations. As illustrated in FIG. 1, dimmer switch 10 may be configured so that when power to a load is turned off, the outer continuous solid surface of backlightable indicator region 600 is not illuminated by a light source which indicates to a user that power is not being delivered to the load.

Figure 3:
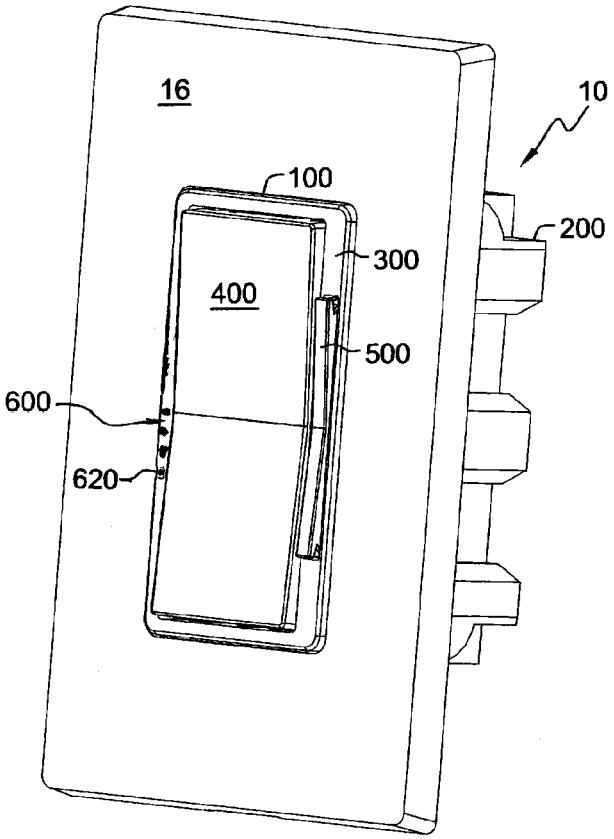
FIG. 3 is a perspective view of the electrical load controller of FIG. 1 illustrating power to a load being turned on so that frame with the integrally formed backlightable indicator region is operably illuminated to indicate a partial supply of electrical power to the load observable by a user.
Figure 4:
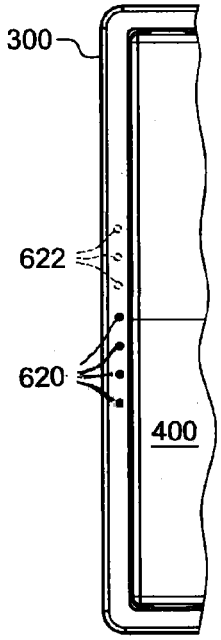
FIG. 4 is an enlarged front view of a portion of the frame and the integrally formed backlightable indicator region of FIG. 3.

As illustrated in FIG. 3, dimmer switch 10 may be configured so that when power to a load is turned on, outer continuous solid surface 610 (FIG. 2) of backlightable indicator region 600 may include one or more backlit illuminated portions 620 being backlit illuminated by a light source to indicate to a user a level of power being supplied to the load. As described in greater detail below, light rays from the light source (not show in FIG. 3) are transmitted onto an inner surface of the frame, transmitted though material forming the frame, and emitted from portions of the outer continuous solid surface (FIG. 2) of the frame. For example, as shown in FIG. 4, a partial supply of full power supplied to a load may correspond to four backlit illuminated portions 620 of a possible seven illuminatable portions, the remaining three possible illuminatable portions 622 not being non-illuminated (illustrated in dashed lines in FIG. 4). In one embodiment, the illuminated portions may appear as illuminated dots or circles, however other suitable configurations may be employed. In addition, while increasing the power may cumulatively light each indicator, other options may include the appearance of one illuminatable portion simply moving upwards or downwards within the region so that only a single indicator is lit at any given time and dependent upon location within the region as a whole to indicate the supplied level of power to the load.

A user may press an upper end or a lower end of intensity level actuator 500 (FIGS. 1 and 3) to operably increase or decrease, respectively, the level of power to the load while causing one or more illuminatable portions being illuminated or not illuminated. For example, when the electrical load controller is configured to control a lamp, the illuminatable portions may correspond to the brightness of the lamp.

With reference again to FIG. 1, the electrical load controller may have the appearance of being absent any observable power level indicator when no power is being supplied to a load. For example, the electrical load controller in an installed state such as when installed on a wall of a room, the "hiding" of a power level indicator may provide a smooth and visually appealing appearance of frame 300 in ambient light. In other embodiments, as described below, an indicator region may be visible to a user in ambient light even when no power is being supplied to a load.

With reference still to FIG. 1, the front face of actuator assembly 100 may extend through an opening of a wall plate 16, thereby providing access to the features of actuator assembly 100, including main actuator 400 and intensity level actuator 500. Main actuator 400 may have any suitable shape, contour, dimensions, angles, etc. for functional and/or aesthetic reasons. The actuator assembly may be configured and releasably attachable to the dimmer module to allow a user to easily replace an existing assembly with a new assembly, for example, in case the existing assembly is damaged. In another example, a releasably attachable actuator assembly may be part of an interchangeable color change kit that enables an installer or end user to easily change the color of the visible portions of the device to coordinate with changes in the building décor or occupant preferences. Thus, an actuator assembly may be replaced without having to remove dimmer module 200/dimmer switch 10. Dimmer switch 10, including dimmer module 200, actuator assembly 100, and also wall plate 16, may be made of a non-conductive material, such as but not limited to, plastic, polymeric, or other well known types of electrically non-conductive material. Alternatively, the user accessible surfaces of the dimmer, once installed, need not be non-conductive as long as the user accessible surfaces are properly grounded and/or electrically isolated from the live electrical parts of the building electrical system.

Figure 5:
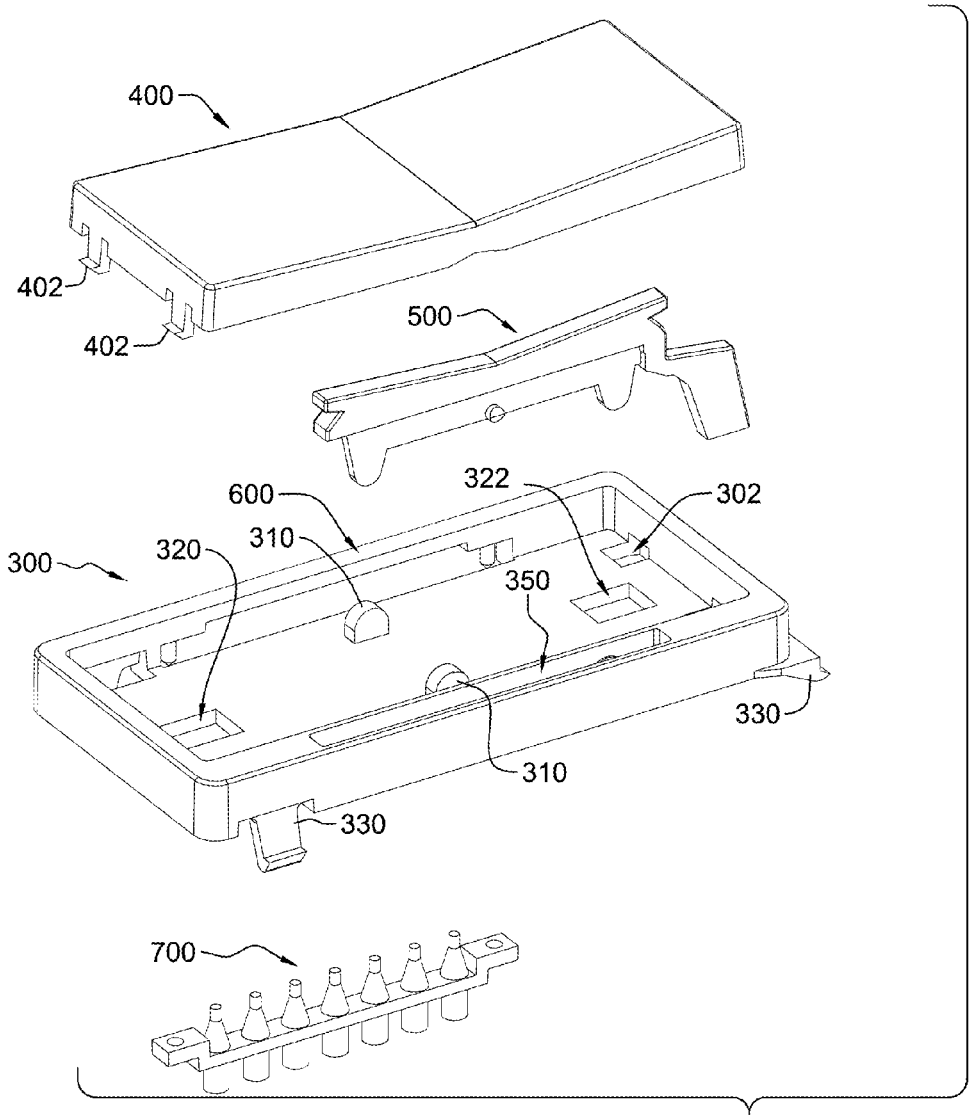
FIG. 5 is an exploded view of the actuator assembly of the electrical load controller of FIG. 1.
Figure 6:
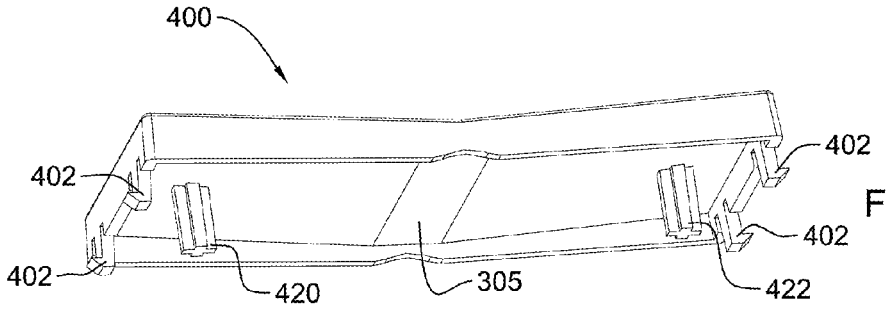
FIG. 6 is a bottom perspective view of the main actuator of FIG. 5.

As shown in FIGS. 5 and 6, in one embodiment, frame 300 and main actuator 400 may be configured to be detachably coupled to each other. For example, tabs 402 on main actuator 400 may be detachably coupled to slots 302 (one of which is shown in FIG. 5) located in frame 300. A central bottom surface 305 (FIG. 6) of main actuator 400 may pivot and/or rock back and forth on pivots 310 of frame 300. Tabs 420 and 422 of main actuator 400 are arranged and configured to extend through openings 320 and 322 of frame 300 (FIG. 5), respectively, for actuating switches inside of the dimmer module 200 for turning the dimmer switch ON and OFF (as explained in greater detail below). Intensity level actuator 500 may be pivotally coupled to frame 300 in an opening 350 in frame 300. A light guide assembly 700 may be operable for guiding light to backlightable indicator region 600. As shown in FIG. 5, the actuator assembly may be configured to be detachably coupled to an upper housing portion of dimmer module 200. For example, tabs 330 of frame 300 may be detachably coupled to slots (not shown) located in the dimmer module 200 (FIG. 1).

Figure 8:
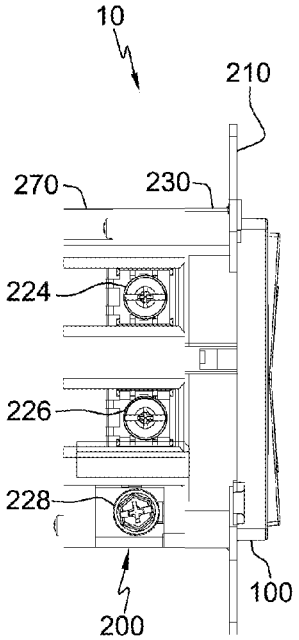
FIG. 8 is a left side elevational view of the electrical load controller of FIG. 7.
Figure 7:
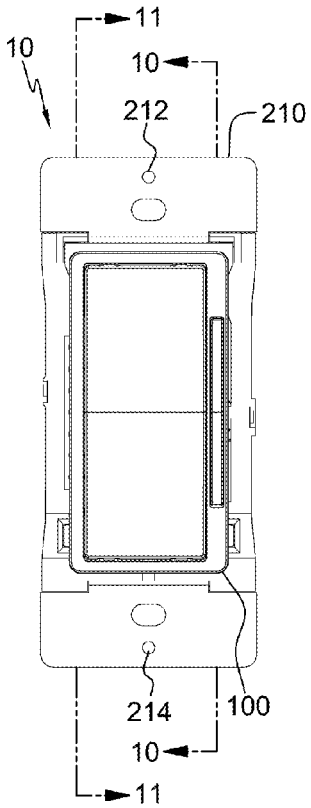
FIG. 7 is a front elevational view of the electrical load controller of FIG. 1.
Figure 9:
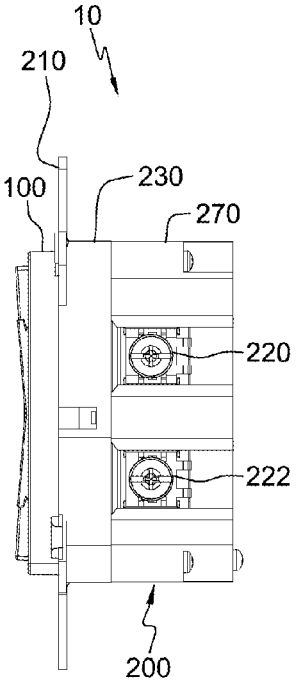
FIG. 9 is a right side elevational view of the electrical load controller of FIG. 7.

With reference to FIGS. 7-9, dimmer switch 10 may include a mounting plate 210 that may be positioned generally between actuator assembly 100 and dimmer module 200. In this exemplary embodiment, mounting plate 210 may include openings 212 and 214 to mount dimmer switch 10 to an electrical junction box (not shown). Mounting plate 210 may be sized to be mounted to an electrical junction box and be covered by a wall plate. Dimmer module 200 may include electrical wiring terminals 220, 222, 224, 226, and 228 (i.e., line phase terminal, line neutral terminal, load terminal, ground terminal) to secure electrical conductors to dimmer switch 10. Alternatively, dimmer module 200 may include electrical wiring leads (not shown) to secure the premises electrical wiring conductors to the dimmer switch 10. Mounting plate 210 can be made of a non-conductive or conductive material and in the case of a conductive material, e.g., aluminum, may include a ground terminal (not shown) for connection to a ground conductor of an electrical wiring system. Dimmer module 200 may include an upper housing 230 and a lower housing 270. Alternate embodiments may include any suitable number of wiring terminals or leads to secure electrical conductors to the dimmer switch 10.

Figure 10:
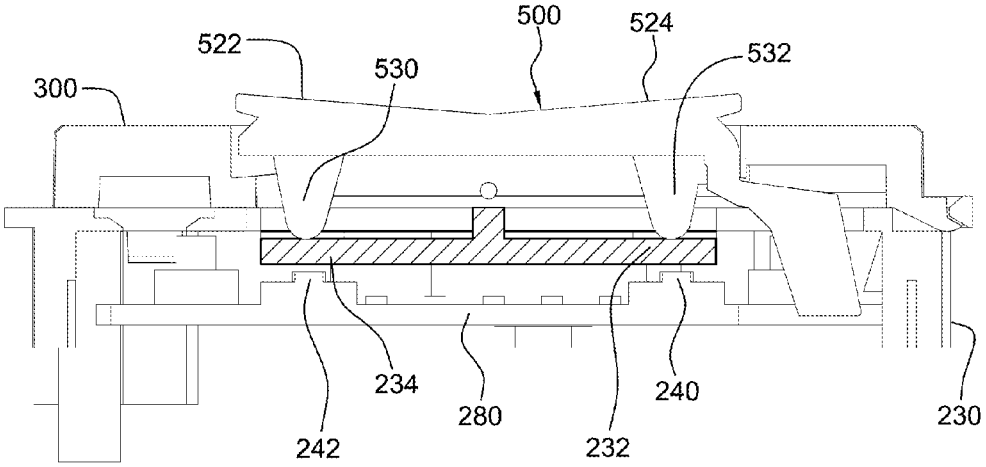
FIG. 10 is an enlarged cross-sectional view, rotated 90 degrees, of the frame, the intensity level actuator, and the upper housing portion taken along line 10-10 in FIG. 7.

With reference to FIG. 10, intensity level actuator 500 may move between two brightness controlling positions. For example, in a first brightness controlling position, upper end 524 may be pressed toward frame 300 so that intensity level actuator leg 532 moves towards, and engages, a leaf spring 232, which further actuates a first switch 240 for increasing the power to the load. First switch 240 and leaf spring 232 may be a snap-action switch disposed within the upper housing 230.

Similarly, in a second brightness controlling position, by pressing end 522 downwardly, intensity level actuator leg 530 may engage a leaf spring 234, wherein the leaf spring actuates a second switch 242 for decreasing the power to the load. Second switch 242 and leaf spring 234 may be a snap-action switch disposed within upper housing 230. A second/bottom housing 270 (FIGS. 8 and 9) of the dimmer module may support a printed circuit board (PCB) 280 which holds circuitry for performing dimmer functions such as switching a light on or off and adjusting power to a light. The PCB may support a power switch (not shown in FIG. 10) and an air-gap switch (not shown in FIG. 10). It should be noted that the dimmer may be assembled in any of a number of suitable manners not limited to the structure described herein.

Figure 11:
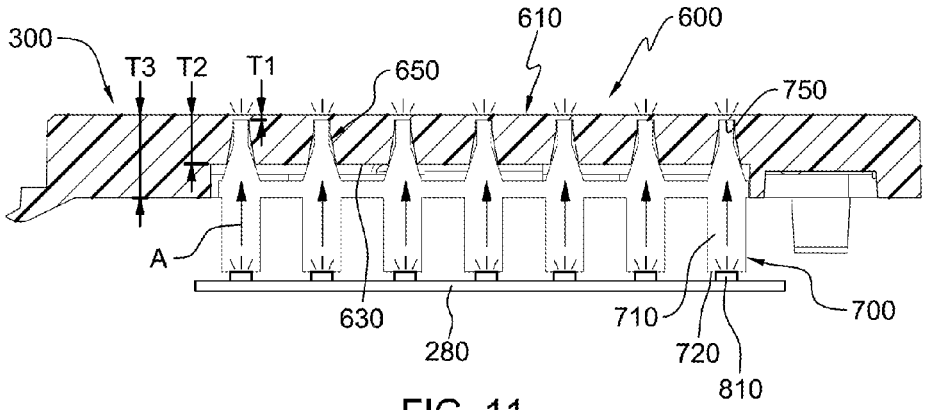
FIG. 11 is an enlarged cross-sectional view, rotated 90 degrees, of the frame with the integrally formed backlightable indicator region, the light guide assembly, and the circuit board having LEDs taken along line 11-11 in FIG. 7.

As shown in FIG. 11, backlightable indicator region 600 may be integrally formed in or part of frame 300. For example, the frame and the integrally formed backlightable indicator region may have a monolithic, unitary, one-piece, or single-piece construction. The frame and integrally formed backlightable indicator region may be absent adhesives, fasteners, or mechanical joints for connection of the backlightable indicator region to the frame. In one exemplary embodiment, the frame may be manufactured by injection molding.

Backlightable indicator region 600 includes outer continuous solid surface 610 (also shown in FIG. 2) that is operable as a status indicating area configured to emit light to indicate a power level status to a user. Backlightable indicator region 600 may include an inner surface 630, portions of which define a plurality of cavities 650 disposed below outer surface 610. Light guide assembly 700 may include a plurality of light guides 710 having a respective lower end 720 and an upper end 750. Upper ends 750 may be operably received in respective cavities 650. The cavities and upper end of the light guides may be adapted so that such fitting encourages a directing of light to inner surfaces of the cavities in the frame of the backlightable indicator region. Respective lower ends 720 of light guides 710 may be disposed to receive light emitted from respective LEDs 810 disposed on circuit board 280. Light guides 710 may each have a longitudinal axis and the longitudinal axis may be disposed perpendicular to the backlightable indicator region. As will be appreciated, light guide assembly 700 is operable to direct light transmitted from the LEDs, through the light guide, to the inner surfaces of the cavities in the frame, which light is transmitted through material of the frame, and emitted from the outer surface to indicate a status of the electrical load controller. The light guide assembly may be a one-piece or monolithic structure or assembled from two or more components. The light guide assembly and/or light guides may be formed from a plastic or polymeric material such as polycarbonate, or other suitable materials. In other embodiment of an electrical load controller, light from one or more light sources may be emitted directly toward one of more inner surfaces of a backlightable indicator region and not require the use of a separate light guide assembly or light guides.

The section of frame 300 defining the integrally formed backlightable indicator region 600 may have a general thickness T2 between outer surface 610 and an inner surface 630, and a plurality of spaced apart reduced thickness sections, e.g., having a thickness T1 between outer surface 610 and the inner surface of cavity 650. Portions of the frame spaced from the backlightable indicator region may have a thickness T3 between an outer surface of the frame and an inner surface of the frame. For example, T1 may be about 0.020 inch and T2 may be about 0.20 inch. As will be appreciated, the solid backlightable indicator region may not include through holes or through apertures that open at the outer surface of the backlightable indicator region 600. As such, there is not, a hollow passageway through backlightable indicator region 600, to the inner surface of the backlightable indicator region 600. In other words, cavities 650 are blind holes, not through holes. For example, the outer continuous solid surface results in none of the light emitted from the light source or LED being observable by a user that does not pass through material defining integrally formed backlightable indicator region 600. The reduced thickness may have a greater transmittivity of the light from the light source compared to general thickness T2.

As will be appreciated, a suitable thickness or thickness of the backlightable indicator region may be provided so that the backlightable indicator region provides a uniform look and/or color when no electrical power is supplied to the load. For example, the backlightable indicator region may have a suitable thickness and/or colorant so that when no electrical power is supplied to a load, the frame observable by the user in ambient light, e.g., light in a room, appears to the user having the same look or color around the outer surface of the frame. The frame and backlightable indicator region may appear to be substantially or essentially opaque under ambient light conditions.

In operation of an electrical load controller in accordance with the present disclosure, the number of illuminated LEDs, and thus, the corresponding illuminated portions on the upper surface of the backlightable indicator region provides an illuminated indication to a user of the electrical power level supplied to a load. For example, no energized LEDs may correspond to no electrical power being supplied to a load. With seven LEDs illustrated in FIG. 11, one energized LED may illuminate one portion of the upper surface of backlightable indicator region and correspond to 1/7 of the maximum electrical power suppliable to the load, two energized LED may illuminate two portions of the upper surface of backlightable indicator region and may correspond to 2/7 of the maximum electrical suppliable to the load, etc. As shown in FIG. 11, the seven energized LEDs may illuminate seven portions of the upper surface of backlightable indicator region and may correspond to a maximum electrical power being supplied to the load. In the illustrated embodiment of FIG. 11, the illuminatable portions of the outer surface of backlightable indicator region may be a plurality of spaced-apart or discontinuous illuminatable areas, for example a plurality of spaced-apart illuminatable dots arranged in a line.

As illustrated in FIG. 11, light emitted from the LEDs travel through the light guide from one end to the other end in a general direction as illustrated by arrows A. The light exits the light guide, is received onto an inner surface of the backlightable indicator region, transmitted through portions of the backlightable indicator region and exits along a portion of the outer surface of the backlightable indicator region. The backlightable indicator region is operable to provide a user a brightness status, condition, or level, or alternatively dimming level, condition, or a status.

Figure 12:
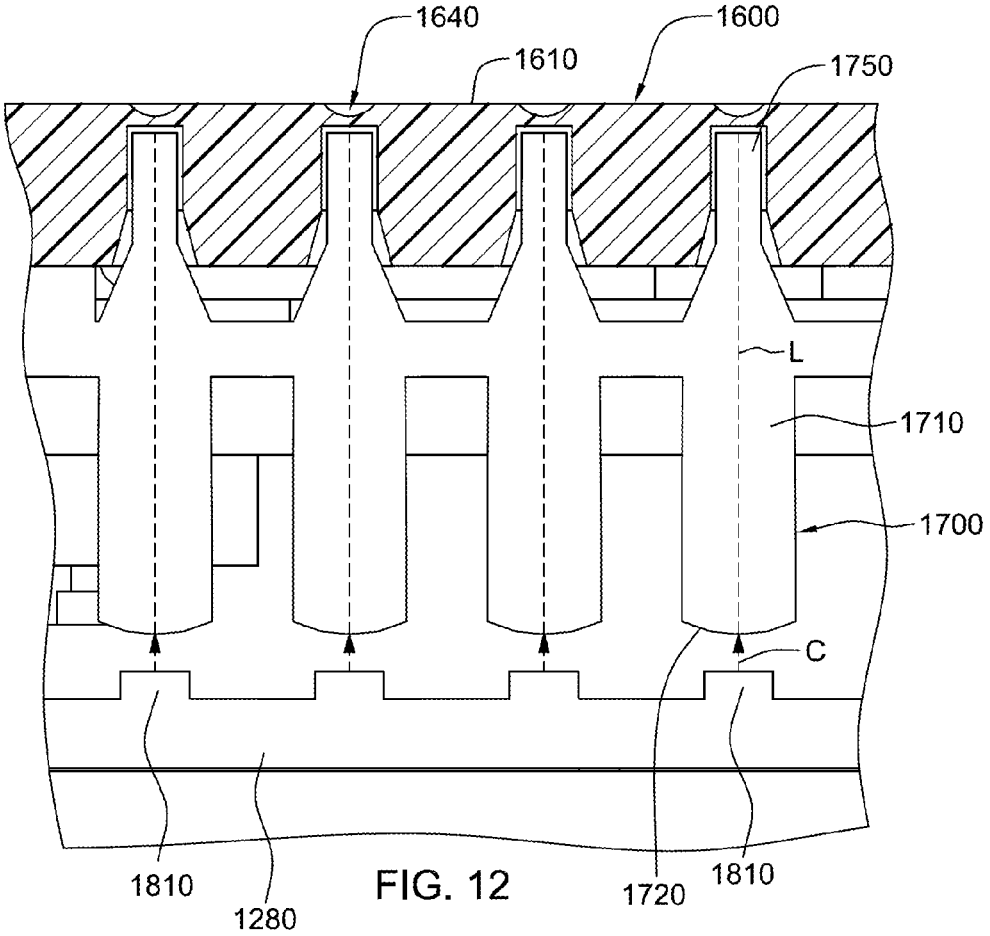
FIG. 12 is a cross-sectional view of a portion of an integrally formed backlightable indicator region having an outer surface with a plurality of recesses, a light guide assembly, and a circuit board having LEDs in accordance with aspects of the present disclosure.

FIG. 12 illustrates another embodiment of a portion of an integrally formed backlightable indicator region 1600 having an outer continuous solid surface 1610 with a plurality of spaced-apart recesses 1640, a light guide assembly 1700 having light guides 1710, and a circuit board 1280 having LEDs 1810 in accordance with aspects of the present disclosure. For example, each of the plurality of recess may be aligned with or disposed over a different one of ends 1750 of the light guides. The recesses may define a concave surface such as dimples or have other suitable configurations.

Figure 13:
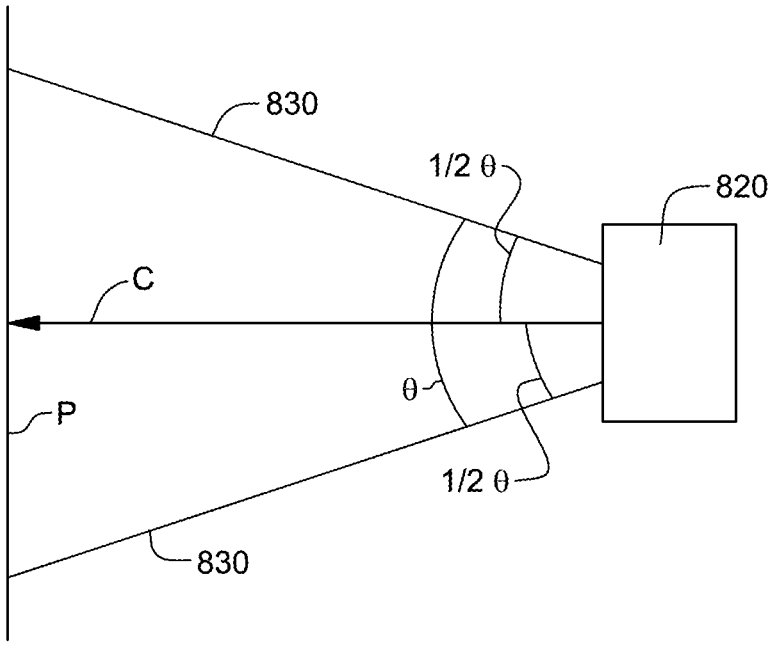
FIG. 13 is a schematic diagram of a light source in accordance with aspects of the present disclosure.

As shown in FIG. 13, a light source 820 may have a cone angle defined by outer boundary light rays 830. A cone angle at the light source may be, e.g., about 30 degrees, about 45 degrees, or about 60 degrees. A light source, for example, an LED light source may have a central emission vector C directed centrally with respect to the outer boundary light rays defining an illumination cone angle of the light source. The outer boundary light rays, which may define the cone angle of the light source, may be light rays that delimit points on a target plane, P, at which luminous intensity is half a maximum value, wherein the target plane, P, is normal to the central emission vector.

With reference again to FIG. 12, central emission vectors C of light from LED may extend in directions co-extensive with longitudinal axes L of the light guides, which may increase a throughput of light through the backlightable indicator region. Light diffusion aiding features may be provided unrelated to a direction of central emission vectors. As shown in FIG. 12, a lower end 1720 of the light guides may be shaped in the form of a lens. Lower ends 1720 may define a convex lens surface. The convex lens surface may have a focal point and focal length that optimizes light at the upper end 1750 of the light guides, and may improve light throughput. In other embodiments, the focal point of the lens may have a focal length that define a plane of optimum focus within a light guide a distance away from the distal end of the light guide, e.g. a distance of more than 10% of the length of light guide. In such embodiment, the light guides may focus light for improved light diffusion.

Figure 14:
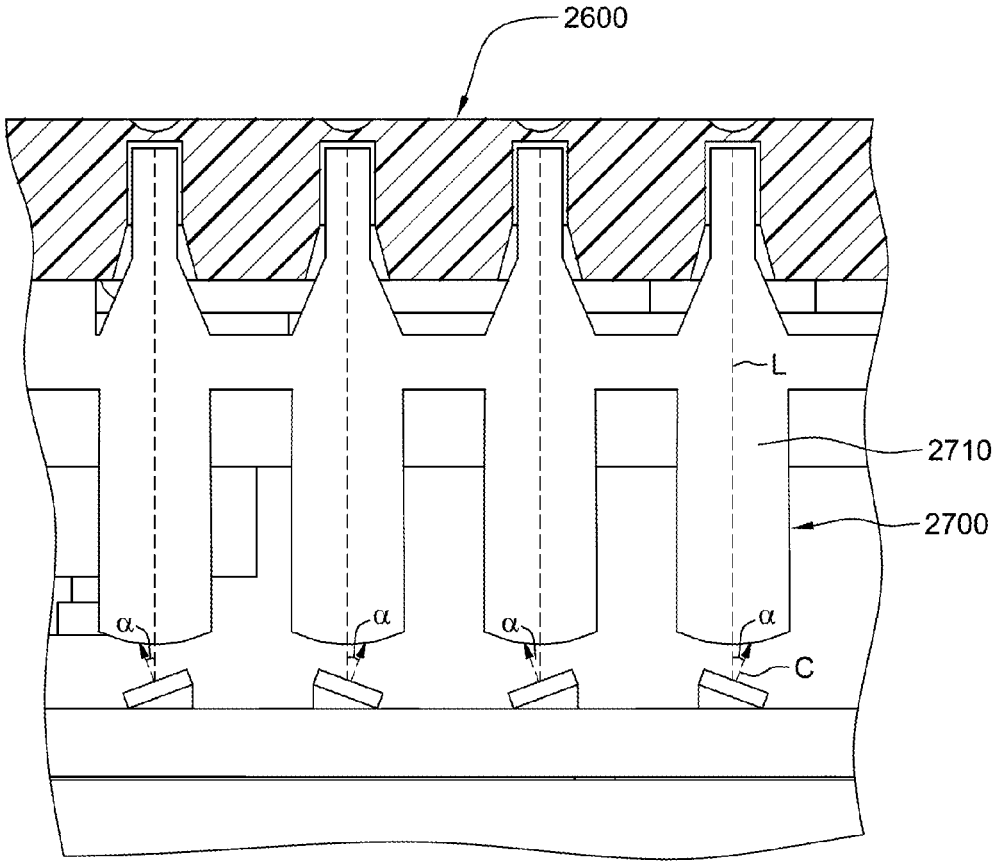
FIG. 14 is a cross-sectional view of a portion of a frame and an integrally formed backlightable indicator region having an outer surface with a plurality of space-apart depressions, a light guide assembly, and a circuit board having LEDs disposed on an angle in accordance with aspects of the present disclosure.
Figure 15:
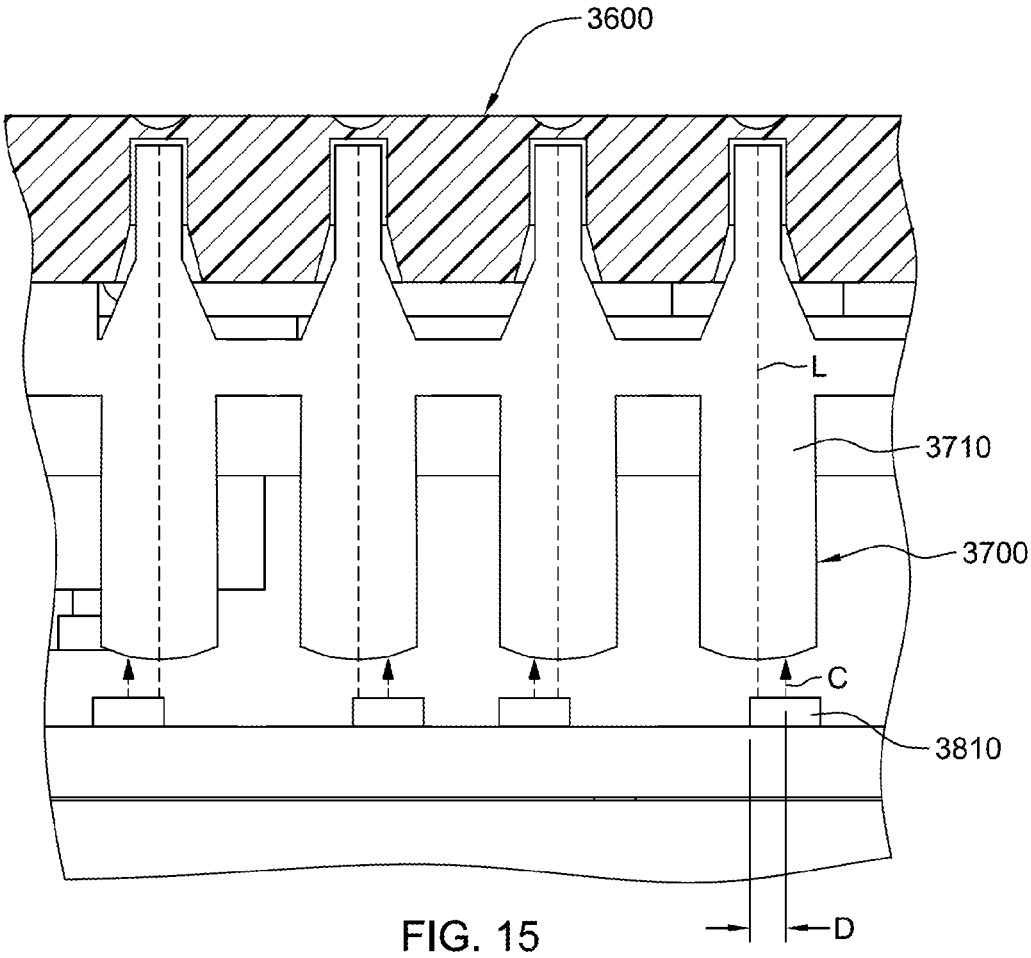
FIG. 15 is a cross-sectional view of a portion of a frame and an integrally formed backlightable indicator region having an outer surface with a plurality of space-apart depressions, a light guide assembly, and a circuit board having LEDs disposed offset relative to the longitudinal axis of the light guide in accordance with aspects of the present disclosure.

FIG. 14 illustrates another embodiment of an integrally formed backlightable indicator region 2600, a light guide assembly 2700 having a plurality of light guides 2710, and a plurality of LEDs 2810. In this illustrated embodiment, the LEDs are disposed so that central emission vectors C of the LEDs extend at an angle that is not perpendicular with reference the printed circuit board nor aligned or parallel with the longitudinal axis L of the light guides. Such a configuration may aid in the alleviation of hot spots in light emissions from the light sources, and encourage a diffuse emission pattern of illumination emitted from the backlightable indicator region. FIG. 15 illustrates another embodiment of an integrally formed backlightable indicator region 3600, a light guide assembly 3700 having a plurality of light guides 3710, and a plurality of LEDs 3810. Hot spots may be reduced by disposing the light sources so that central emission vectors C of the light sources extend in directions parallel to longitudinal axes L of the light guides but are offset a distance D from the longitudinal axes of the light guides as shown in FIG. 15. In other embodiments, the central emission vectors of the light sources may be offset from longitudinal axes of the light guide and may extend at angles.

Figure 16:
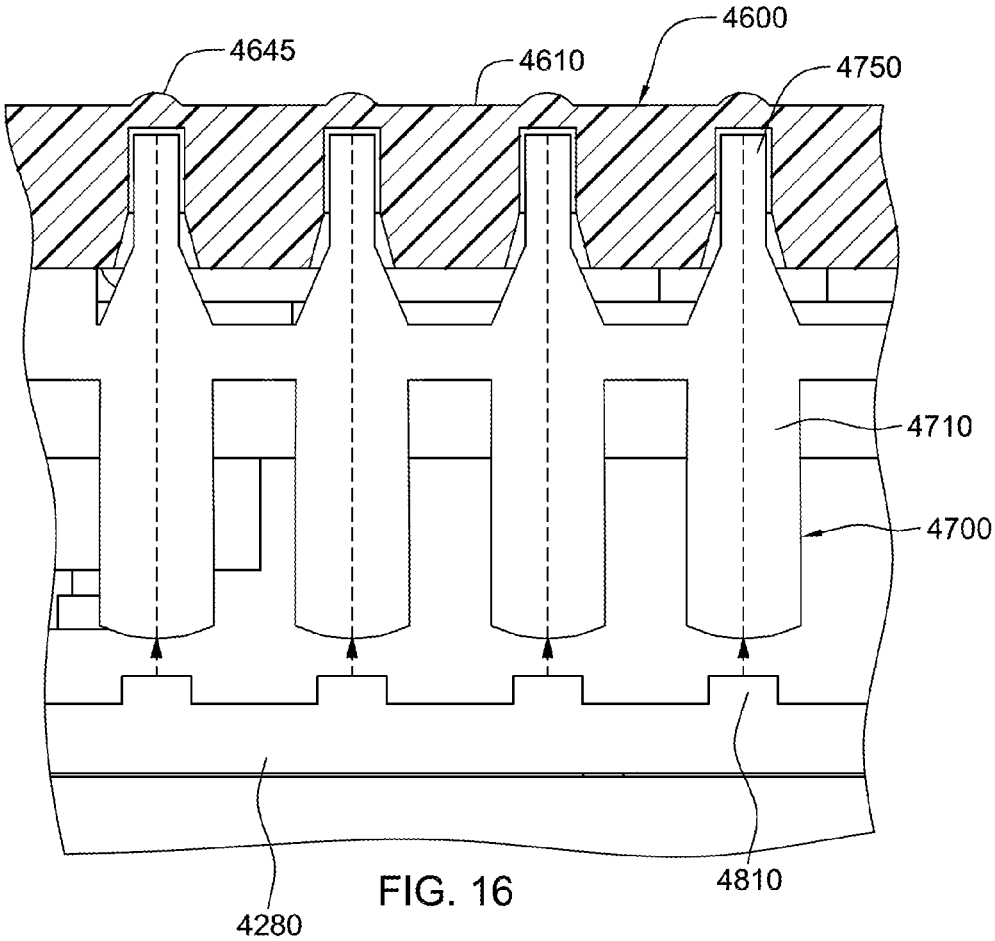
FIG. 16 is a cross-sectional view of a portion of a frame and an integrally formed backlightable indicator region having an outer surface with a plurality of space-apart projections, a light guide assembly, and a circuit board having LEDs in accordance with aspects of the present disclosure.

FIG. 16 illustrates another embodiment of a portion of an integrally formed backlightable indicator region 4600 having an outer continuous solid surface 4610 with a plurality of spaced-apart projections 4645, a light guide assembly 4700 having light guides 4710, and a circuit board 4280 having LEDs 4810 in accordance with aspects of the present disclosure. For example, each of the plurality of raised portions or projections may be aligned with or disposed over a different one of ends 4750 of the light guides. The projections may define convex surfaces or have other suitable configurations.

In other embodiments, the inner surface of an integrally formed backlightable indicator region may have a plurality of recesses such as concave portions or a plurality of projections such as convex portions. In further embodiments, the recessed portions or projections such as convex or concave portions may act lenses for focusing light received on the inner surface and light emitted from the outer surface.

Figure 17:
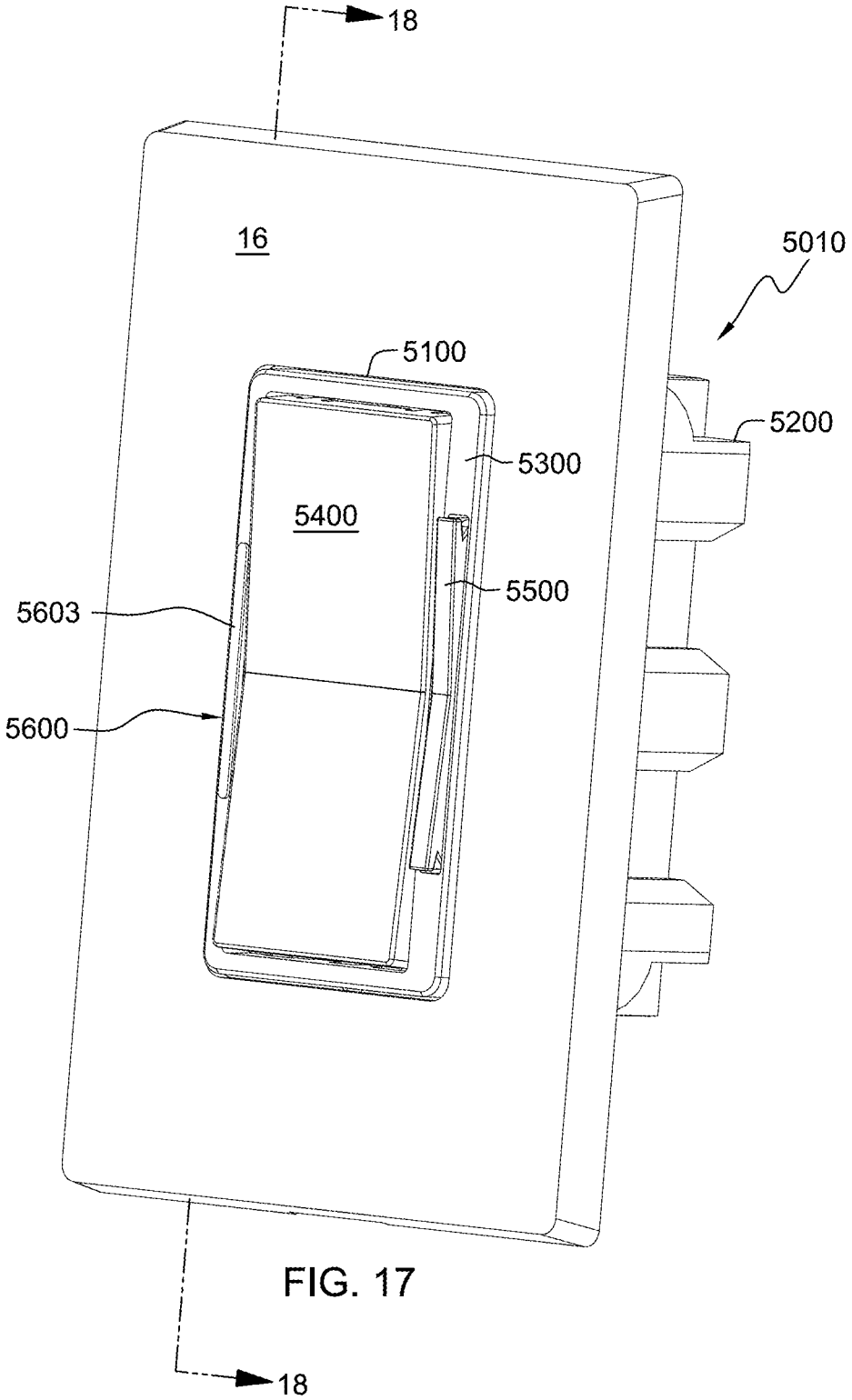
FIG. 17 is a perspective view of another embodiment of an electrical load controller such as a dimmer switch illustrating power to a load being turned off so that a frame having an integrally formed, elongated raised, backlightable indicator region is not illuminated in accordance with aspects of the present disclosure.

FIG. 17 illustrates an exemplary embodiment of an electrical load controller, such as a dimmer switch 5010, in accordance with aspects of the present disclosure. In this exemplary embodiment, dimmer switch 5010 may generally include an actuator assembly 5100 coupled to a dimmer module 5200. Actuator assembly 5100 may be a self-contained unit which includes a frame 5300, a main actuator 5400, and an intensity level actuator 5500. Generally, a user may operate dimmer switch 5010 by pressing main actuator 5400 to operably switch power ON or OFF to a load, such as but not limited to a light fixture or to a fan. In addition, a user may operate intensity level actuator 5500 to adjust the level of power to the load. While the main actuator and intensity level actuator are illustrated as extending outwardly from the frame, it will be appreciated that the main actuator and intensity level actuator may be recessed relative to the frame. In addition, it will be appreciated that the frame, the main actuator, and the intensity level actuator may have any suitable configuration or arrangement.

Figure 18:
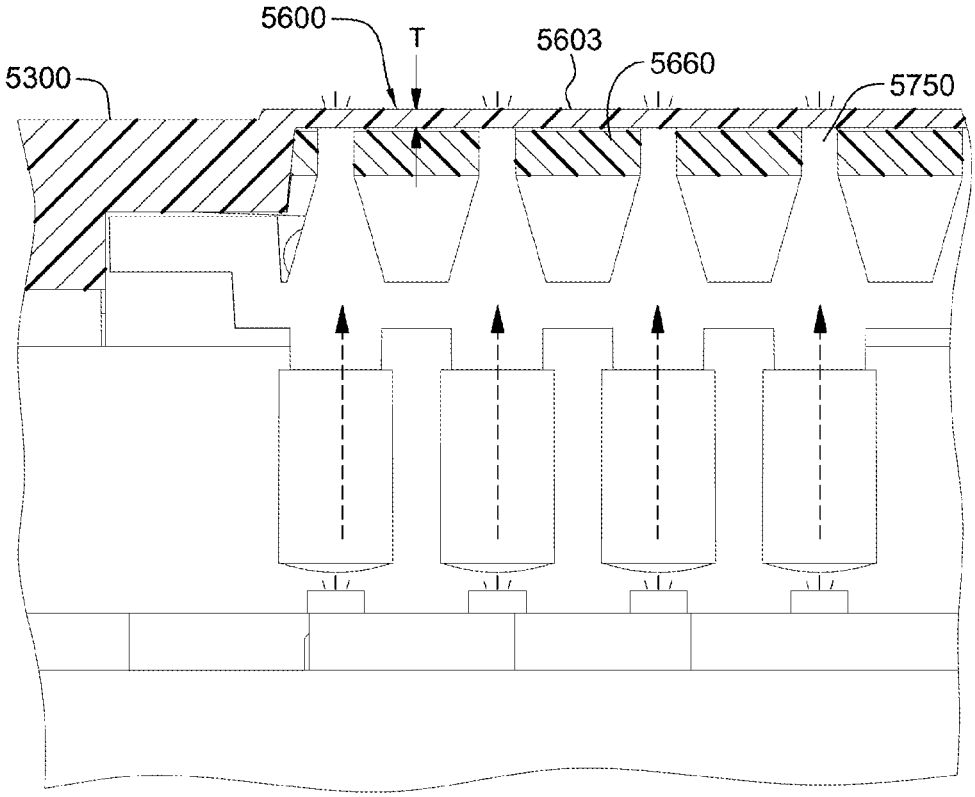
FIG. 18 is an enlarged cross-sectional view, rotated 90 degrees, of a portion of the frame and the integrally formed backlightable indicator region, the light guide assembly, and the circuit board having LEDs taken along taken along line 18-18 in FIG. 17.

As shown in FIG. 17, frame 5300 includes an integrally formed backlightable indicator region 5600 in the form of an elongated raised surface or land 5603 positioned, as shown in FIG. 18, adjacent to ends 5750 of light guides 5710 of light guide assembly 5700. In one configuration, the elongated raised land may have a constant thickness T, and a constant width and length along the outer surface. In other embodiments, the outer surface of the land may further include recesses or raised portions. For example, each recess or raised portion may be aligned with or disposed over a different one of the ends of the light guide. In still other embodiments, an integrally formed backlightable indicator region may include one or more elongated grooves recessed in the outer surface of integrally formed backlightable indicator region. In still other embodiments, a raised elongated land may have a tapering width along its length, for example, wherein a wider end may represent a full power level and the narrower end may represent a minimal power level.

An opaque member may be disposed adjacent to the inner surface of the integrally formed backlightable indicator region. For example, a shown in FIG. 18, an opaque member 5660 may be disposed adjacent to the inner surface of the constant thickness integrally formed backlightable indicator region. The opaque member may have one or more openings for receiving an end of the light guide to allow light to reach the inner surface of the integrally formed backlightable indicator region. With such a configuration, the bleeding of light between the openings may be inhibited or reduced, and when power is supplied to a load. Alternative embodiments may include a member having different optical properties (e.g. translucent) instead of opaque member 5660.

In the various embodiments, the frame and the integrally formed backlightable indicator region may be formed from a material and include a colorant, for example, a white colorant, black colorant, red colorant, green colorant, blue colorant, or colorant of another color. The colorant may be uniform throughout the frame and the integrally formed backlightable indicator region. Instead of being uniform throughout, the colorant may be applied in a non-uniform pattern to indicate to a user the backlightable indicator region. Such a non-uniform pattern may define a user observable upper and lower limit of the indicator region in ambient light when no power is supplied to the load. The frame and integrally formed backlightable indicator region may be plastic or polymer based, including but not limited to nylon, polycarbonate, etc. The colorant may include one or more dyes or pigments. The frame and the integrally formed backlightable indicator region may be injection molded and colorant can be included in the feed stock. The integrally formed backlightable indicator region may be solid, or may have a density less than the other portion of the frame. For example, the integrally formed backlightable indicator region may include the material having closed cells with trapped gas thereby reducing the density of the material forming the integrally formed backlightable indicator region and increasing the transmittivity of light therethrough.

Figure 19:
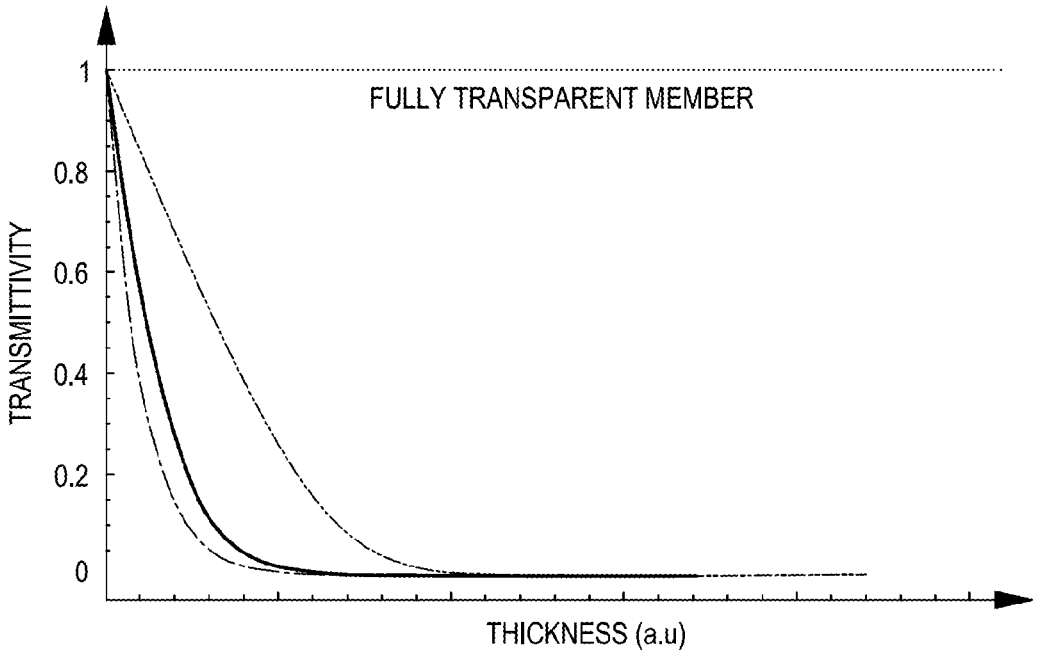
FIG. 19 is a graph of visible light transmittivity verses thickness of various materials.

In the development of apparatus and methods described herein it was determined that a transmittivity of visible light through a material can degrade as the thickness of the material is increased. FIG. 19 illustrates transmittivity characteristics of various materials as a function of thickness. In one embodiment, the solid line curve shown in FIG. 19 may be a baseline thickness transmittivity curve for a material. The curve can be shifted left (less transmittive) by addition of colorant in a feedstock for molding of a member. The curve can be shifted right (more transmittive) by reduction of colorant from a feedstock for molding of member. In one embodiment, the solid line depicted in FIG. 19 can be a transmittivity curve for an integrally formed backlightable indicator region of a frame.

In the development of apparatus and methods described herein, it was observed that a visible light transmittivity of the integrally formed backlightable indicator region of the frame may be tuned to a desired percent (%) transmittivity value by adjustment of the thickness. In Table A below, listed are various different embodiments of a frame (numbered 1-20) having an integrally formed backlightable indicator region with a reduced thickness portions and a major thickness portions.

TABLE A

| | Average Transmittivity at Regions of Reduced Thickness | Average Transmittivity at Regions Having Major Thickness |
|---|---|---|
| 1 | ≥60% | ≤40% |
| 2 | ≥60% | ≤30% |
| 3 | ≥60% | ≤20% |

TABLE A-continued

| | Average Transmittivity at Regions of Reduced Thickness | Average Transmittivity at Regions Having Major Thickness |
|---|---|---|
| 4 | ≥60% | ≤10% |
| 5 | ≥60% | ≤5% |
| 6 | ≥60% | ≤2% |
| 7 | ≥70% | ≤20% |
| 8 | ≥80% | ≤10% |
| 9 | ≥80% | ≤5% |
| 10 | ≥80% | ≤2% |
| 11 | ≥40% | ≤30% |
| 12 | ≥40% | ≤10% |
| 13 | ≥40% | ≤5% |
| 14 | ≥30% | ≤20% |
| 15 | ≥30% | ≤10% |
| 16 | ≥50% | ≤40% |
| 17 | ≥30% | ≤5% |
| 18 | ≥30% | ≤2% |
| 19 | ≥20% | ≤5% |
| 20 | ≥20% | ≤2% |

Figure 20:
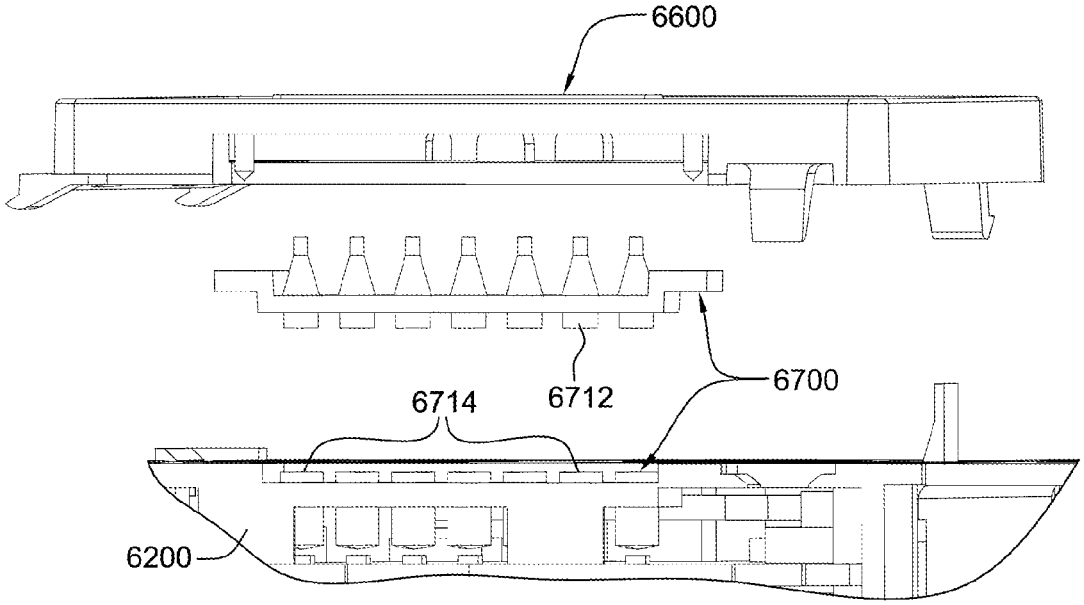
FIG. 20 is a cross-sectional view of a portion of a frame and an integrally formed backlightable indicator region, a light guide assembly having separable portions, and a circuit board having LEDs in accordance with aspects of the present disclosure.

With reference to FIG. 20, a light guide assembly 6700 may be adapted to be separatable along the length of a plurality of light guides 6712 and 6714 in response to a manually applied force in accordance with aspects of the present disclosure. Such a configuration may avoid a risk of damage to light guide assembly or to other components of electrical load controller if the actuator assembly is removed from a remainder of electrical load controller for servicing or replacement. Light guide assembly 6700 may include upper light guide portions 6712 disposable adjacent to an inner surface of an integrally formed backlightable indicator region 6600 receivable, and a lower guide portions 6714 attachable to module 6200. In other embodiments, a light guide assembly may include a breakaway upper portion such as when the actuator assembly is removed from a remainder of electrical load controller for servicing or replacement.

Figure 21:
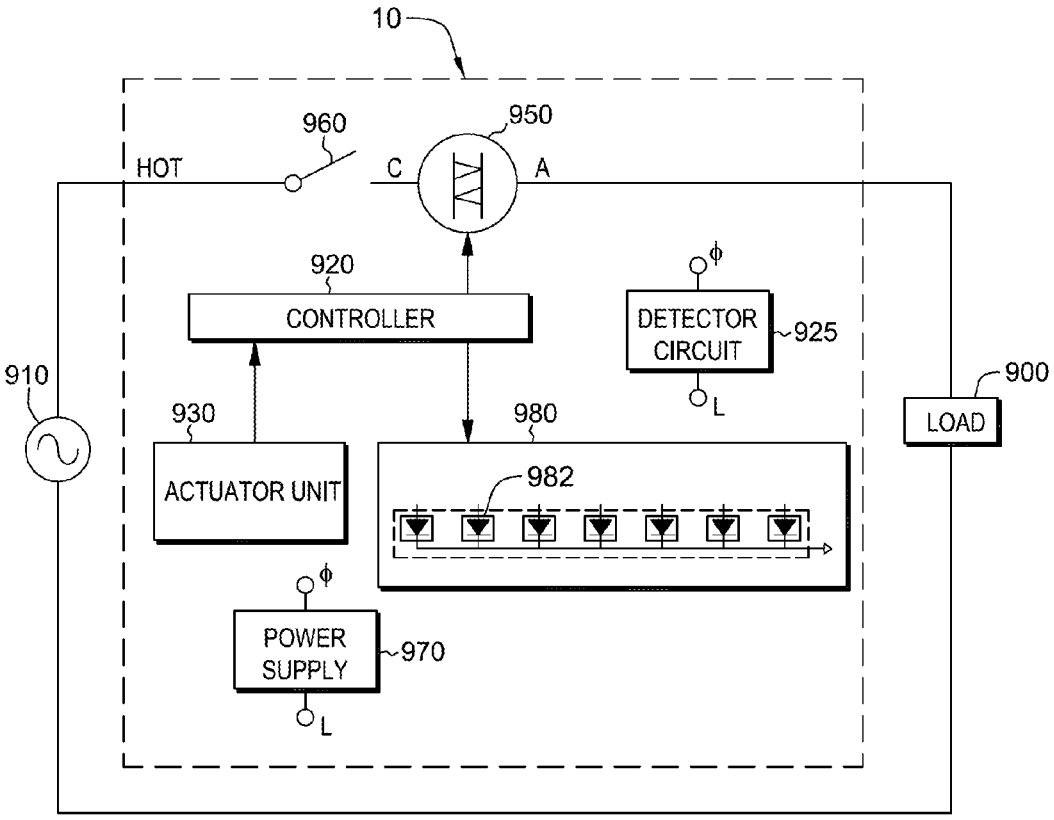
FIG. 21 is one embodiment of a circuit diagram for use in an electrical load controller in accordance with aspects of the present disclosure.

FIG. 21 is a diagram illustrating an embodiment of electrical load controller such as dimmer switch 10 connected to a load 900, such as but not limited to a light or a fan, connected between the hot/phase and neutral terminals of a standard source 910 of electrical energy. In this illustrated embodiment, dimmer switch 10 may include a controller 920 such as but not limited to a microprocessor/microcontroller coupled to a user accessible actuator unit 930. User accessible actuator unit 930, in turn, interfaces with one or more main actuator switches, and one or more intensity level actuator switches, such as switches 240 and 242 (FIG. 10), and a power switch 950 (described in greater detail below), such as but not limited to a solid state switching device, connected in series with air gap switch 960. Air gap switch 960 is a mechanical switch such that when the air gap switch is open, the electrical load controller and the load are isolated from source 910. Opening up the air gap switch is referred to as a "hard switch off" which allows a user to, for instance, change or replace a lamp or a fan without risk of an electrical shock.

The electrical energy transmitted to the load can be controlled by switch 950 to switch on load 900, increase or decrease the intensity of load 900, or switch off electrical load 900. A power supply 970, such as a DC power supply, operably provides power to the circuitry of the device. Dimmer switch 10 may include a detector circuit 925 for detecting line voltages (described in greater detail below).

Dimmer switch 10 includes an illumination assembly 980 for indicating the level of power supplied to dimmer switch 10. For example, light sources or LEDs 982 are operable to indicate a level of power supplied to the load in connection with the integrally formed backlightable indicator regions as described above. Illumination assembly 980 can be controlled by signals sent from controller 920 in response to user actuation of the actuators of actuator assembly 903. The LEDs may be powered by DC current from power supply 970.

In one embodiment, the dimmer switch may selectively provide a varying portion of the electrical energy available at the input to the load. Such a device, for example, may supply a fraction of the input voltage to the load with the fraction being selected by the user. For example, switch 950 may be in the form of any suitable switch, including but not limited to, a solid state switching device or controllably conductive device may be a thyristor, a TRIAC, a SCR, a MOSFET, etc. Switch 950 may be controlled by controller 920 to provide adjustable power to the load, e.g., control the on/off state and the brightness level such as to a light. In one embodiment, switch 950 may be a Triode for Alternating Current (TRIAC) such as a bidirectional three terminal semiconductor device that allows bidirectional current flow when an electrical signal of proper amplitude is applied to its "G" (or gate) terminal, a "C" (or cathode terminal), and an "A" or anode terminal. When an electrical signal of proper amplitude is applied to the gate G of a TRIAC, the TRIAC is said to be gated. When properly gated, current (or other electrical signal) can flow bidirectionally between the Cathode "C" terminal to the Anode "A" terminal. When not gated or not properly gated, relatively very little or substantially no current (or no signal) can flow between the "A" and "C" terminals. A TRIAC thus may allow some or no current flow based on the amplitude of the electrical signal applied to its "G" terminal. Alternatively, a switch may include two TRIACs, a first TRIAC may be controlled by controller 920 which applies a fire signal onto control line 115 to turn on the second TRIAC, which in turn then gates the first TRIAC allowing an AC signal to pass through a load and back to a power source via a neutral terminal.

Source 910 of electrical energy can be a 120/220 volt AC (alternating current), 60/50 Hz signal. The AC signal (current and/or voltage) may be a sinusoidal voltage signal symmetrically alternating about a zero volt reference point. Detector circuit 925 may include a zero crossing detector circuit for detecting the zero crossings of source 910. Controller 920 may use the output of a zero-crossing detector of detector circuit 925 for various timing functions such as the proper timing of signals it generates for controlling switch 950. In one embodiment, the power switch may be controlled by the controller to limit the output voltage to a fraction of that of a full sine wave. Additionally, it may be advantageous to have switch 950 interrupt current to the load only at zero crossings of source 910 to reduce unnecessary arcing. Other suitable dimming mechanisms can be used without departing from the spirit of the disclosure.

From the present description above, it will be appreciated that other embodiments of the electrical load controller may be provided. For example, illuminatable dots for indicating the level of power supplied to the load may be circular, or have other illuminatable configurations such as square, triangular, hexagon, and other spaced-apart two-dimensional regions, spaced-apart three-dimensional regions. In other embodiment, the illuminated portions may form a continuous illuminated area. For example, a continuous illuminated may be an illuminable line. The length of the line may correspond to the supplied power level supplied to the load. In still other embodiments, various colored or painted indicia may be included on the outer surface of the indicator region.

In view the present disclosure, it will be appreciated that the integrally formed indicator region may be integrally formed with the frame in other locations of the frame than that described above. For example when the electrical load controller is disposed on a wall, instead of the indicator region being disposed along a side of the frame, the indicator region may be disposed along the top of the frame or along the bottom of the frame. In addition, the integrally formed indicator region may be disposed on one or more of the sides, top and bottom of the frame.

In addition, the integrally formed indicator region may be operably configured and integrally formed with the main actuator instead of the frame. For example, with reference to FIG. 1, an illumination assembly may be disposed behind main actuator 400, and main actuator 400 may include an integrally formed indicator region having an inner surface and an outer continuous solid surface.

Further, the electrical load controller may be operably configured to include the integrally formed indicator region disposed in the wall plate. Accordingly, the light corresponding to the power level supplied to the load may be operably directed to such integrally formed indicator regions of the wall plate.

It will be appreciated from the above description and techniques of the present disclosure that one or more embodiments of the electrical load controller may result in the frame, and in particular, the indicator region of the frame with the absence of through holes or apertures being configured to be resistant to retention of debris (such as dirt and cleansing liquids), and/or reduce the likelihood of a user mistaking the indicator region for an actuator such as the intensity level actuator.

The terminology used herein is for the purpose of describing particular embodiments only and is not intended to be limiting of the invention. Dimensional and other parameter information provided herein including characterizing terminology (e.g. "uniform") are understood to be in terms of industry accepted tolerances unless the context indicates otherwise. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Similarly he term "defined by" shall mean "at least partially defined by" unless the context indicates otherwise. Furthermore, a device or structure that is configured in a certain way is configured in at least that way, but may also be configured in ways that are not listed. Furthermore, where an apparatus or method is set forth herein as including a certain number of elements, the apparatus can be practiced with less than or more than the certain number of elements.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An electrical load controller for use in controlling electrical power to a load from an electrical power source, said electrical load controller comprising:

an electrical switching device for turning electrical power on and off to the load and for controlling a level of power to the load;

an actuator assembly comprising:

at least one user actuator actuatable by a user for use in turning on and off electrical power to the load and for use in adjustably controlling the level of power to the load;

a frame operably attached to said at least one actuator, and said frame comprising an integrally formed backlightable indicator region comprising an outer continuous solid surface; and an illumination assembly for providing illumination related to the level of power to the load;

wherein light from said illumination assembly related to the level of power to the load is directable onto a portion of an inner surface of said backlightable indicator region, transmittable through said backlightable indicator region from said inner surface to said outer surface, emittable from a portion of said outer surface, and observable by the user.

2. The electrical load controller of claim 1 wherein said indicator region in ambient light is not discernible as an indicator region by a user when electrical power is turned off to the load.

3. The electrical load controller of claim 1 wherein said frame and said indicator region comprise the same observable color when electrical power is off to the load.

4. The electrical load controller of claim 1 wherein light emittable from said outer surface of said indicator region related to the level of power to the load comprises a plurality of spaced-apart illuminatable outer surface portions.

5. The electrical load controller of claim 1 wherein said indicator region comprises a generally constant thickness.

6. The electrical load controller of claim 1 wherein said indicator region does not comprise an aperture opening onto the outer surface, extending from said outer surface to said inner surface, and opening onto said inner surface.

7. The electrical load controller of claim 1 wherein said outer surface of said indicator region comprises a plurality of spaced-apart recessed areas, and wherein light from said illumination assembly related to the level of power to the load is emittable from said plurality of spaced-apart recessed portions of said outer surface.

8. The electrical load controller of claim 1 wherein said inner surface of said indicator region comprises a plurality of spaced-apart recessed portions, and wherein light from said illumination assembly related to the level of power to the load is receivable in said spaced-apart recessed portions of said inner surface.

9. The electrical load controller of claim 1 wherein said outer surface of said indicator region comprises a plurality of spaced-apart raised portions, and wherein light from said illumination assembly related to the level of power to the load is emittable from said plurality of spaced-apart raised portions of said outer surface.

10. The electrical load controller of claim 1 wherein said outer surface of said indicator region comprises an elongated raised land relative to said frame.

11. The electrical load controller of claim 1 wherein at least one of said inner surface of said indicator region comprises a plurality of spaced-apart raised portions that act as lenses for receiving light, and said outer surface of said indicator region comprises a plurality of spaced-apart raised portions that act as lenses for emitting light.

12. The electrical load controller of claim 1 wherein the indicator assembly comprises an LED array, and a plurality of light guides that direct light from said LED array towards said indicator region.

13. The electrical load controller of claim 1 further comprising a housing, and wherein said actuator assembly is releasably attachable to said housing.

14. An electrical load controller for use in controlling electrical power to a load from an electrical power source, said electrical load controller comprising:

an electrical switching device for turning electrical power on and off to the load and for controlling a level of power to the load;

an actuator assembly comprising:

a main actuator actuatable by a user for use in turning on and off electrical power to the load;

a peripherally-extending frame disposed around said main actuator;

an intensity level actuator extendable though an opening in said peripherally-extending frame, said intensity level actuator actuatable by a user for use in adjustably controlling the level of power to the load; and said peripherally-extending frame comprising an integrally formed indicator region comprising an outer continuous solid surface;

an illumination assembly for providing illumination related to the level of power to the load, said an illumination assembly comprising a light source and a plurality of light guides; and wherein light from said illumination assembly related to the level of power to the load is directable onto a portion of an inner surface of said backlightable indicator region, transmittable through said backlightable indicator region from said inner surface to said outer surface, emittable from a portion of said outer surface, and observable by the user.

15. The electrical load controller of claim 14 wherein said indicator region is not discernible as an indicator region by a user when electrical power is turned off to the load.

16. The electrical load controller of claim 14 wherein said indicator region and said frame comprise a generally uniform observable surface color in ambient light when electrical power is off to the load.

17. The electrical load controller of claim 14 wherein light emitted from said outer surface of said indicator region related to the level of power to the load comprises a plurality of spaced-apart illuminated portions.

18. The electrical load controller of claim 14 wherein said integrally formed indicator region comprises a generally constant thickness.

19. The electrical load controller of claim 14 wherein said outer surface of said indicator region comprises an elongated raised land relative to said frame.

20. The electrical load controller of claim 14 wherein said outer surface of said indicator region comprises a plurality of spaced-apart recessed portions or a plurality of spaced-apart raised portions, and wherein light from said illumination assembly related to the level of power to the load is emittable from said plurality of spaced-apart recessed portions or said raised portions of said outer surface.

21. The electrical load controller of claim 14 wherein said indicator region does not comprise an aperture opening onto the outer surface, extending from said outer surface to said inner surface, and opening onto said inner surface.

22. The electrical load controller of claim 14 further comprising a housing, and wherein said actuator assembly is releasably attachable to said housing.

23. An actuator assembly attachable to an electrical switching device of an electrical load controller, said actuator assembly comprising:

a main actuator actuatable by a user for use in turning on and off electrical power to the load;

a peripherally-extending frame disposed around said main actuator;

an intensity level actuator extendable though an opening in said peripherally-extending frame, said intensity level actuator actuatable by a user for use in adjustably controlling the level of power to the load;

said peripherally-extending frame comprising an integrally formed indicator region comprising an outer continuous solid surface; and wherein light from an illumination assembly in said electrical load controller related to the level of power to the load is directable onto a portion of an inner surface of said backlightable indicator region, transmittable through said backlightable indicator region from said inner surface to said outer surface, emittable from a portion of said outer surface, and observable by the user.

24. The actuator assembly of claim 23 wherein said indicator region is not discernible as a indicator region by a user in ambient light when electrical power is turned off to the load.

25. The actuator assembly of claim 23 wherein said indicator region and said frame comprise a generally uniform observable surface color in ambient light when electrical power is turned off to the load.

26. The actuator assembly of claim 23 wherein said outer surface of said indicator region comprises a plurality of spaced-apart recessed portions or a plurality of spaced-apart raised portions, and wherein light from said illumination assembly related to the level of power to the load is emittable from said plurality of spaced-apart recessed portions or said plurality of spaced-apart raised portions of said outer surface.

27. The actuator assembly of claim 23 wherein said outer surface of said indicator region comprises an elongated raised land relative to said frame.

28. The actuator assembly of claim 23 wherein said indicator region does not comprise an aperture opening onto the outer surface, extending from said outer surface to said inner surface, and opening onto said inner surface.

29. The actuator assembly of claim 23 wherein light emittable from said outer surface of said indicator region related to the level of power to the load comprises a plurality of spaced apart illuminated outer surface portions.

30. The actuator assembly of claim 23 further comprising said illumination assembly comprising at least a portion of one light guide.

31. The actuator assembly of claim 23 wherein said actuator assembly is releasably attachable to a housing of an electrical load controller.

* * * * *